United States Patent [19]

Artzberger

[11] Patent Number: 4,991,321

[45] Date of Patent: Feb. 12, 1991

[54] PNEUMATIC DEVICE FOR EXCAVATING AND REMOVING MATERIAL

[75] Inventor: Thomas G. Artzberger, Menomonee Falls, Wis.

[73] Assignee: M-B-W Inc., Slinger, Wis.

[21] Appl. No.: 541,375

[22] Filed: Jun. 21, 1990

[51] Int. Cl.[5] ..... E02F 3/88

[52] U.S. Cl. ..... 37/62; 37/63; 37/58

[58] Field of Search ..... 37/58, 59, 61, 62, 63, 37/75, 76, 78

[56] References Cited

U.S. PATENT DOCUMENTS

| | | | |
|---|---|---|---|
| 1,778,942 | 10/1930 | Harp | 37/63 |
| 1,994,884 | 3/1935 | Chew | 37/63 |
| 3,585,740 | 6/1971 | de Koning et al. | 37/63 |
| 3,674,100 | 7/1972 | Becker | 37/63 X |
| 3,858,398 | 1/1975 | Van Weele | 37/78 X |
| 4,479,741 | 10/1984 | Berti et al. | 37/63 X |
| 4,497,519 | 2/1985 | Grable | 37/63 X |
| 4,776,731 | 11/1988 | Briggs et al. | 406/153 |

FOREIGN PATENT DOCUMENTS 0251660 of 1988 European Pat. Off. .

*Primary Examiner*—Dennis L. Taylor
*Assistant Examiner*—J. Russell McBee
*Attorney, Agent, or Firm*—Andrus, Sceales, Starke & Sawall

[57] ABSTRACT

A high velocity pneumatic device for excavating and removing material such as soil. The device includes an elongated pressure tube having an inlet end connected to a source of gas, such as air, under pressure and the opposite or distal end is bent and projects into a removal tube. The projecting end of the pressure tube is provided with a pair of outlets with a first of the outlets facing away from the inlet end and the second outlet facing toward the inlet end. A nozzle is removably connected in the first outlet and is constructed to increase the velocity of air being discharged through the nozzle toward the soil to thereby dislodge or excavate the soil. A plug containing an orifice is connected to the second outlet and air flowing from the pressure tube through the orifice creates as aspirating action to draw the dislodged soil upwardly through the removal tube to a discharge site. By incorporationg a solid plug or closure in the second outlet in place of the orifice, the device can be used solely for excavating, and by connecting a solid plug in the first orifice the tool can be used only for removal of material.

23 Claims, 2 Drawing Sheets

PNEUMATIC DEVICE FOR EXCAVATING AND REMOVING MATERIAL

BACKGROUND OF THE INVENTION

High velocity pneumatic devices are used in construction work to excavate or dislodge soil from around electrical cables, water pipes, gas mains, and the like. The pneumatic device has the advantage of being capable of pulverizing the soil without damaging the utility lines.

The typical high velocity pneumatic device consists of a body or housing which carries an elongated tube. The body is connected to a source of air under pressure, such as a compressor, and a valve mechanism mounted in the body controls the flow of air to the tube. Mounted in the distal end of the tube is a nozzle which is designed to increase the velocity of the air being discharged from the tube toward the soil. The typical nozzle is provided with an inwardly converging upstream end which merges into a diverging downstream end. This configuration acts to reduce the pressure of the air and increase its velocity. High velocity pneumatic devices have also been employed to remove dislodged soil or other material. The evacuation device includes an elongated rigid tube and air under pressure is supplied through jets into the distal end of the tube and directed inwardly of the tube away from the distal end, thus creating an aspirating action to draw material through the tube. In use, the elongated tube is positioned over the shoulder of the operator and the material is discharged form the upper end of the tube behind the operator.

SUMMARY OF THE INVENTION

The invention is directed to a high velocity pneumatic device which can be used for both excavating and removing material, such as soil. The device includes a body or housing which carries an elongated pressure tube. The body is connected to a source of air under pressure, such as a compressor, and a valve mechanism, located in the body, controls the flow of air to the pressure tube.

The outer or distal end of the tube is bent and projects laterally into a removal tube. The projecting end of the pressure tube is provided with a pair of outlets, with one of the outlets facing outwardly away from the body, while the second outlet faces inwardly toward the body. A nozzle is removably connected to the first outlet and is designed to increase the velocity of the 10 air flowing through the nozzle toward the soil. The high velocity air being discharged from the nozzle will serve to dislodge or pulverize the soil.

A plug is connected to the second outlet in the pressure tube and contains one or more orifice openings. A portion of the air in the pressure tube is directed through the second outlet and the air flowing through the orifices creates as aspirating action to draw the pulverized or dislodged soil upwardly into the removal tube. A flexible conduit can be connected to the end of the removal tube to direct the removed soil to a discharge site. In this mode of operation, the device can be employed to not only dislodge the soil, but to remove the soil from the excavation site.

In a second mode of operation, the device can be used merely for excavating. In this situation, a solid plug or closure is substituted for the plug containing the orifice, so that the entire volume of air is directed through the nozzle for excavating purposes.

In a third mode of operation, a solid plug or closure is connected in the first outlet in place of the nozzle, thus resulting in the entire volume of air being directed through the orifice to create an aspirating action. In this mode of operation, the device merely serves to remove material and performs no excavating function.

The invention thus enables a single tool to perform either an excavating function, a removal function, or a combination of both. This constitutes a substantial advantage over prior art devices in which separate tools were required for both excavating and removal operations.

With the use of a flexible conduit connected to the removal tube, the removed soil can be discharged in any desired location, which is a substantial advantage over prior devices in which the removed soil was discharged in a single location behind the operator.

As a further advantage, if a large object, such as a stone, is drawn up into the removal tube and lodges against the projecting end of the pressure tube, the stone can be removed by merely shutting of the flow of air and without disassembly of any components of the device.

As the nozzle is composed of non-sparking metal, such as brass, and the pressure tube is formed of a dielectric material, the device has improved safety characteristics as compared with pneumatic soil excavators, as used in the past.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
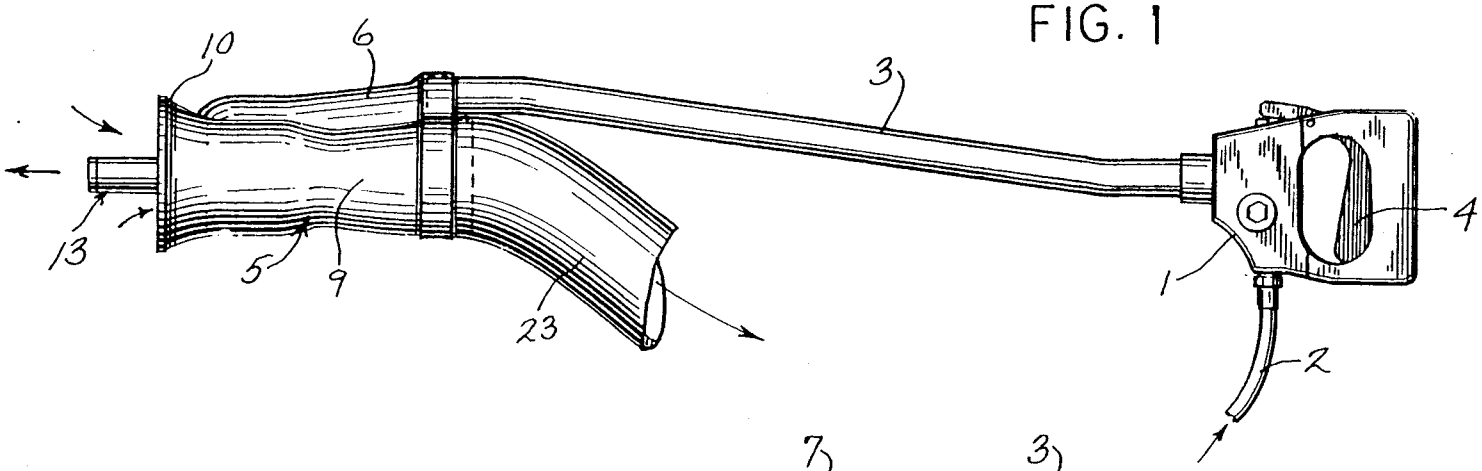
FIG. 1 is a side elevation of the pneumatic device of the invention.

The drawings illustrate a high velocity pneumatic device which has particular use in excavating or dislodging soil around utility lines, trees, shrubs, or the like.

The device includes a body or housing 1 which is connected through an air supply line 2 to a source of air under pressure, such as an air compressor. An elongated tube 3, preferably formed of an electrically non-conductive or dielectric material, such as fiber reinforced resin, is connected to the body 1 and a control valve mechanism, not shown, located within body 1 and actuated by a trigger 4, controls the flow of air through the body to the tube 3. The trigger and valve control mechanism can be constructed, as disclosed in U.S. patent application Ser. No. 541,377, filed June 21, 1990, and the construction of that application is incorporated herein by reference.

The outer or distal end of tube 3 is connected to a metal housing 5. Housing 5 includes a conduit 6, having an internal shoulder 7, and the distal end of tube 3 is inserted within the end of the conduit and abuts shoulder 7.

Figure 2:
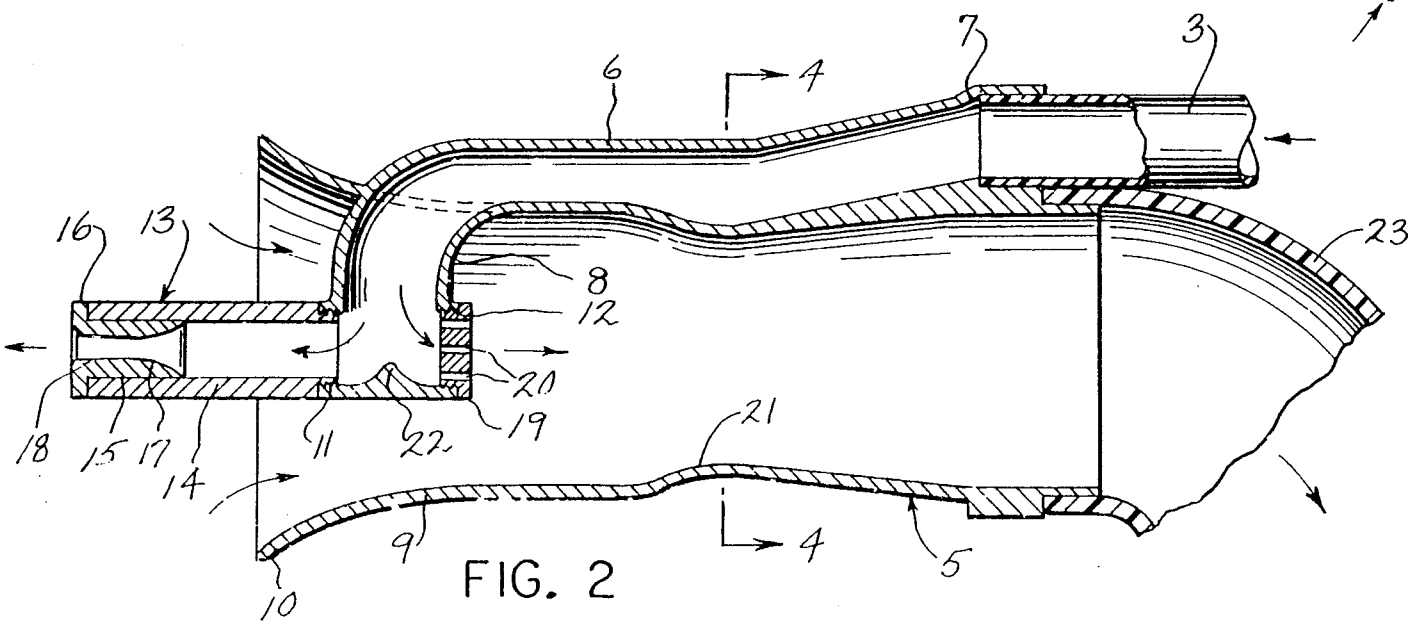
FIG. 2 is an enlarged fragmentary longitudinal section showing the device used to both excavate and remove soil.
Figure 4:
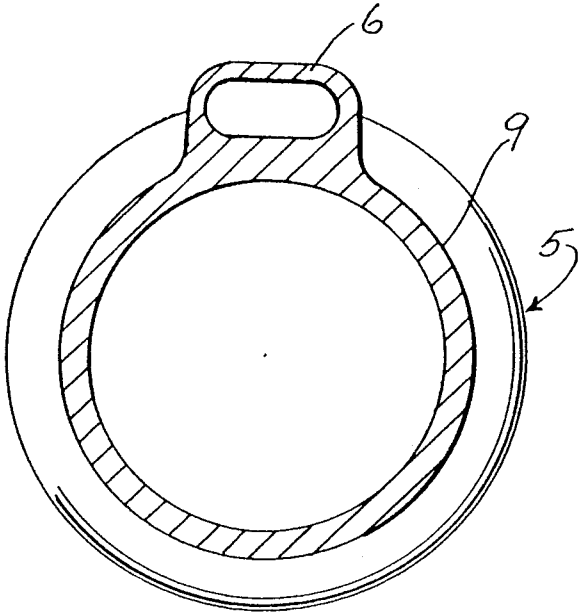
FIG. 4 is a section taken along line 4—4 of FIG. 2.

As illustrated in FIG. 2, the outer end of conduit 6 is bent inwardly at approximately 90°, as indicated at 8, and extends through an opening in a removal tube 9. The outer or distal end 10 of tube 9 is flared outwardly.

The bent projecting end 8 of conduit 6 is provided with a pair of outlets 11 and 12. Outlet 11 faces outwardly away from body 1, while outlet 12 is located approximately 180° from outlet 11 and faces inwardly toward body 1.

A nozzle assembly 13 is threaded to outlet 11 and the nozzle assembly includes a cylindrical sleeve 14 and a nozzle 15 is mounted in the outer end of the sleeve. Nozzle 15 is formed of a non-sparking metal, such as brass, and is preferably secured within the sleeve through use of a suitable adhesive. The outer end of nozzle 15 is formed with an outwardly extending flange 16 which bears against the outer end of sleeve 14, as shown in FIG. 2.

Nozzle 15 is designed in a conventional manner to provide an increase in velocity of the air being discharged from the sleeve 14. The upstream end 17 of the nozzle converges inwardly while the downstream end 18 diverges outwardly. With this construction, the pressure of the air is reduced as it passes through the nozzle, while the velocity is substantially increased. In practice the velocity of the air being discharged in the tube may be in the neighborhood of about 2,000 per second. The high velocity air being discharged from the nozzle acts to effectively pulverize and dislodge the soil from around utility lines, plant roots, and the like.

A plug 19 is threaded within the inwardly facing outlet 12. Plug 19 is provided with a plurality of openings or orifices 20 which preferably have a constant diameter throughout their length. A portion of the high pressure air passing through conduit 6 will flow through the orifices 20 to provide an aspirating action to draw air and soil inwardly through the removal tube 9. The central portion of tube 9 converges inwardly to provide a venturi 21 which aids in obtaining the aspirating action.

In practice, the air compressor may deliver air at a volume of about 170 cfm, and with the device operating in the mode shown in FIG. 2, a volume of about 125 cfm will be discharged through outlet 11 and nozzle 15, while a volume of about 55 cfm will be discharged through the orifices 20 to provide the aspirating action.

The projecting end 8 of conduit 6 is provided with a central curved rib or deflector 22 which aids in directing the air through the pair of outlets 11 and 12.

The upper end of the removal tube 9 is connected to a flexible conduit 23. Conduit 23 can have any desired length that will conduct the removed soil to a desired location. As the conduit 23 is flexible, the discharge of the material can be made to any desired location.

Figure 3:
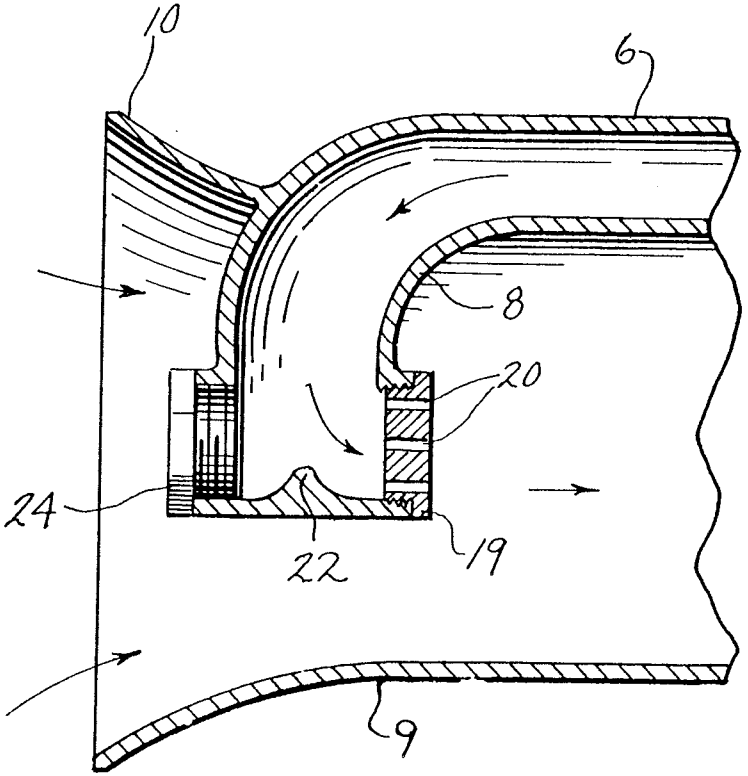
FIG. 3 is a view similar to FIG. 2, showing the device used for soil removal.

As previously noted, in the operational mode shown in FIG. 2, both an excavating and removal function are performed. However, by removing the nozzle assembly 13, and replacing it with a closed threaded plug 24, as shown in FIG. 3, the device will be used solely in a soil removing or excavating mode. In this mode of operation, all of the air being discharged from conduit 6 will be directed through the orifices 20 to provide an aspirating action.

The device can also be used to provide only an excavating or pulverizing operation. In this mode, the plug 19 containing orifices 20 is removed, and a closed plug, similar to plug 24, is threaded in outlet 12. With this arrangement, all of the air flowing through conduit 6 will be directed through the nozzle 15 to provide the excavating action. Thus, the invention enables a single tool to be used for soil excavation, soil removal, or a combination of both.

The device is compact and lightweight and as the nozzle 15 is formed of a non-sparking metal and the pressure tube 3 is composed of a dielectric material, the device has improved safety characteristics which eliminates potential hazards to the operator in the event the device is employed to excavate soil around a ruptured electrical cable or gas main.

In the event a large object or stone is drawn upwardly into the removal tube 9, and lodges against the end 8 of conduit 6, the stone can normally be removed merely by shutting off the flow of air and it is not necessary to disassemble any components of the device to remove the object.

Various modes of carrying out the invention are contemplated as being within the scope of the following claims particularly pointing out and distinctly claiming the subject matter which is regarded as the invention.

I claim:

1. A high pressure pneumatic device for excavating and removing material, comprising a pressure tube having an inlet end connected to a source of air under pressure and having an outlet end, said air being discharged from said outlet end into contact with a material to dislodge said material, a removal tube having an entry end disposed adjacent the outlet end of the pressure tube and having an exit end disposed to deliver material, and aspirating means interconnecting said pressure tube and said removal tube for directing a portion of the air flowing in the pressure tube to the removal tube and causing a flow of air from the entry end of the removal tube to the exit end to thereby draw dislodged material through said removal tube.

2. The device of claim 1, wherein said aspirating means comprises a branch conduit connecting said pressure tube and said removal tube and having an open end facing the exit end of said removal tube.

3. The device of claim 2, and including orifice means disposed in said branch conduit.

4. The device of claim 1, and including nozzle means disposed in the outlet end of said pressure tube means for increasing the velocity of air discharged through said outlet end.

5. The device of claim 4, wherein said nozzle means is disposed between the outlet end of said pressure tube and said aspirating means.

6. The device of claim 1, and including a flexible conduit connected to the exit end of said removal tube for conducting material to a selected site.

7. A high pressure pneumatic device for excavating and removing soil, comprising pressure tube means having an inlet end connected to a source of air under pressure and having a pair of outlets, a first of said outlets facing in a direction away from said inlet end and a second of said outlets facing at an angle to said first outlet, air flowing through said pressure tube means being discharged at high velocity from said first outlet to excavate the soil, removal tube means having an entry end and having an exit end, said second outlet communicating with said removal tube means intermediate the entry and exit ends, and aspirating means associated with said second outlet for drawing air from said pressure tube means into said removal tube means to thereby cause a flow of air through said removal tube means in a direction from said entry end to the exit end to draw dislodged material through said removal tube means.

8. The device of claim 7, and including flow control means associated with the inlet end of said pressure tube means for controlling the flow of air therethrough.

9. The device of claim 7, and including nozzle means removably connected to said first outlet for increasing the velocity of air being discharged through said first outlet.

10. The device of claim 9, wherein said aspirating means comprises orifice means removably connected to said second outlet.

11. The device of claim 7, wherein the axes of said first and second outlets face in opposite directions.

12. The device of claim 9, wherein said nozzle means projects outwardly beyond the entry end of said removal tube means.

13. The device of claim 7, and including flexible conduit means connected to the exit end of said removal tube means.

14. A high pressure pneumatic device for excavating and removing soil, comprising a pressure tube having an inlet end connected to a source of air under pressure and having an outlet end defining a pair of outlets, a first of said outlets facing in a direction away from said inlet end and the second of said outlets facing in a direction toward said inlet end, a removal tube disposed around the outlet end and spaced radially outward of said outlets, said removal tube having an entry end and an exit end, first connecting means for connecting a first element to said first outlet, and second connecting means for connecting a second element to said second outlet.

15. The device of claim 14, wherein said first element comprises nozzle means constructed and arranged to increase the velocity of air being discharged from said first outlet.

16. The device of claim 14, wherein said first element comprises a closure to prevent the flow of air from said first outlet.

17. The device of claim 14, wherein said second element comprises orifice means defining an orifice.

18. The device of claim 14, wherein said second element comprises a closure to prevent the flow of air through said second outlet.

19. The device of claim 14, wherein the entry end of said removal tube is flared outwardly.

20. The device of claim 14, wherein said pressure tube is formed of an electrically non-conductive material.

21. The device of claim 15, wherein said nozzle is formed of a non-sparking metal.

22. A high pressure pneumatic device for excavating and removing soil, comprising a pressure tube having an inlet end connected to a source of air under pressure and having an outer end, a housing defining an open-ended removal tube and a conduit disposed generally parallel to said removal tube, the outlet end of said pressure tube being connected to one end of said conduit and the other end of said conduit being bent inwardly and projecting within said removal tube, the projecting end of said conduit defining a pair of outlets located within said removal tube, said removal tube having an entry end and an exit end, a first of said outlets facing in a direction toward the entry end of said removal tube and a second of said outlets facing in a direction toward the exit end of said removal tube, nozzle means removably connected to said first outlet for increasing the velocity of air flowing through said first outlet, air being discharged from said nozzle means being directed against the soil to dislodge the soil, and orifice means removably connected to said second outlet whereby a portion of the air flowing through said conduit will pass through said orifice means to create an aspirating action in said removal tube to draw the dislodged soil upwardly through said removal tube from said entry end to said exit end.

23. The device of claim 22, and including venturi means associated with said removal tube and located between said second outlet and said exit end.

* * * * *